US011577511B2

(12) United States Patent
Yamazaki

(10) Patent No.: US 11,577,511 B2
(45) Date of Patent: Feb. 14, 2023

(54) LIQUID DISCHARGE HEAD AND LIQUID DISCHARGE APPARATUS

(71) Applicant: Seiko Epson Corporation, Tokyo (JP)

(72) Inventor: Yasushi Yamazaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 17/355,610

(22) Filed: Jun. 23, 2021

(65) Prior Publication Data

US 2021/0402776 A1 Dec. 30, 2021

(30) Foreign Application Priority Data

Jun. 26, 2020 (JP) ..... JP2020-110253

(51) Int. Cl.
*B41J 2/14* (2006.01)

(52) U.S. Cl.
CPC ..... *B41J 2/14233* (2013.01)

(58) Field of Classification Search
CPC ..... B41J 2/14233; B41J 2202/11; B41J 2/14201; B41J 2/07
See application file for complete search history.

(56) References Cited

U.S. PATENT DOCUMENTS

2016/0067967 A1 3/2016 Naganuma et al.
2017/0210133 A1* 7/2017 Tsukahara ..... H01L 41/0475

FOREIGN PATENT DOCUMENTS

JP 2016-058467 4/2016

OTHER PUBLICATIONS

IP.com search (Year: 2022).*

* cited by examiner

*Primary Examiner* — Lisa Solomon
(74) *Attorney, Agent, or Firm* — Workman Nydegger

(57) ABSTRACT

The piezoelectric material has, when viewed in the stacking direction, a first region including a border between an end of the active portion and the non-active portion in an extending direction of the individual electrode, the piezoelectric material has a second region different from the first region, and the piezoelectric material in the first region is thicker than the piezoelectric material in the second region.

12 Claims, 8 Drawing Sheets

LIQUID DISCHARGE HEAD AND LIQUID DISCHARGE APPARATUS

The present application is based on, and claims priority from JP Application Serial Number 2020-110253, filed Jun. 26, 2020, the disclosure of which is hereby incorporated by reference herein in its entirety.

BACKGROUND

1. Technical Field

The present disclosure relates to a liquid discharge head and a liquid discharge apparatus.

2. Related Art

A liquid discharge head disclosed in JP-A-2016-58467 includes a piezoelectric element having a piezoelectric layer disposed on individual electrodes, and a common electrode that is disposed on the piezoelectric layer. The liquid discharge head is provided in, for example, liquid discharge apparatuses such as printers and discharges liquid such as ink by using piezoelectric materials that deform in response to application of a voltage.

In such a liquid discharge head disclosed in JP-A-2016-58467, when a voltage is applied, in the piezoelectric layer, differences in deformation occur in a region between an active portion, which is between the common electrode and the individual electrodes, and a non-active portion, which is not sandwiched between the common electrode and the individual electrodes. In this structure, at the border between the active portion and the non-active portion, stress due to the deformation differences is produced, and this causes cracking in the piezoelectric element.

SUMMARY

According to a first aspect of the present disclosure, there is provided a liquid discharge head that includes piezoelectric materials, individual electrodes each provided to a corresponding one of the piezoelectric materials, a common electrode for the piezoelectric materials, and a vibrating plate configured to vibrate in response to electrical activation of the piezoelectric materials via the individual electrodes and the common electrode. In the liquid discharge head, the piezoelectric materials, the individual electrodes, the common electrode, and the vibrating plate are stacked in a stacking direction, the piezoelectric material has an active portion sandwiched between the individual electrode and the common electrode in the stacking direction, the piezoelectric material has a non-active portion not sandwiched between the individual electrode and the common electrode in the stacking direction, the piezoelectric material has, when viewed in the stacking direction, a first region including a border between an end of the active portion and the non-active portion in an extending direction of the individual electrode, the piezoelectric material has a second region different from the first region, and the piezoelectric material in the first region is thicker than the piezoelectric material in the second region.

According to a second aspect of the present disclosure, a liquid discharge apparatus is provided. The liquid discharge apparatus includes the liquid discharge head according to the first aspect, and a controller configured to control a discharge operation of the liquid discharge head.

DESCRIPTION OF EXEMPLARY EMBODIMENTS

A. First Embodiment

Figure 1:
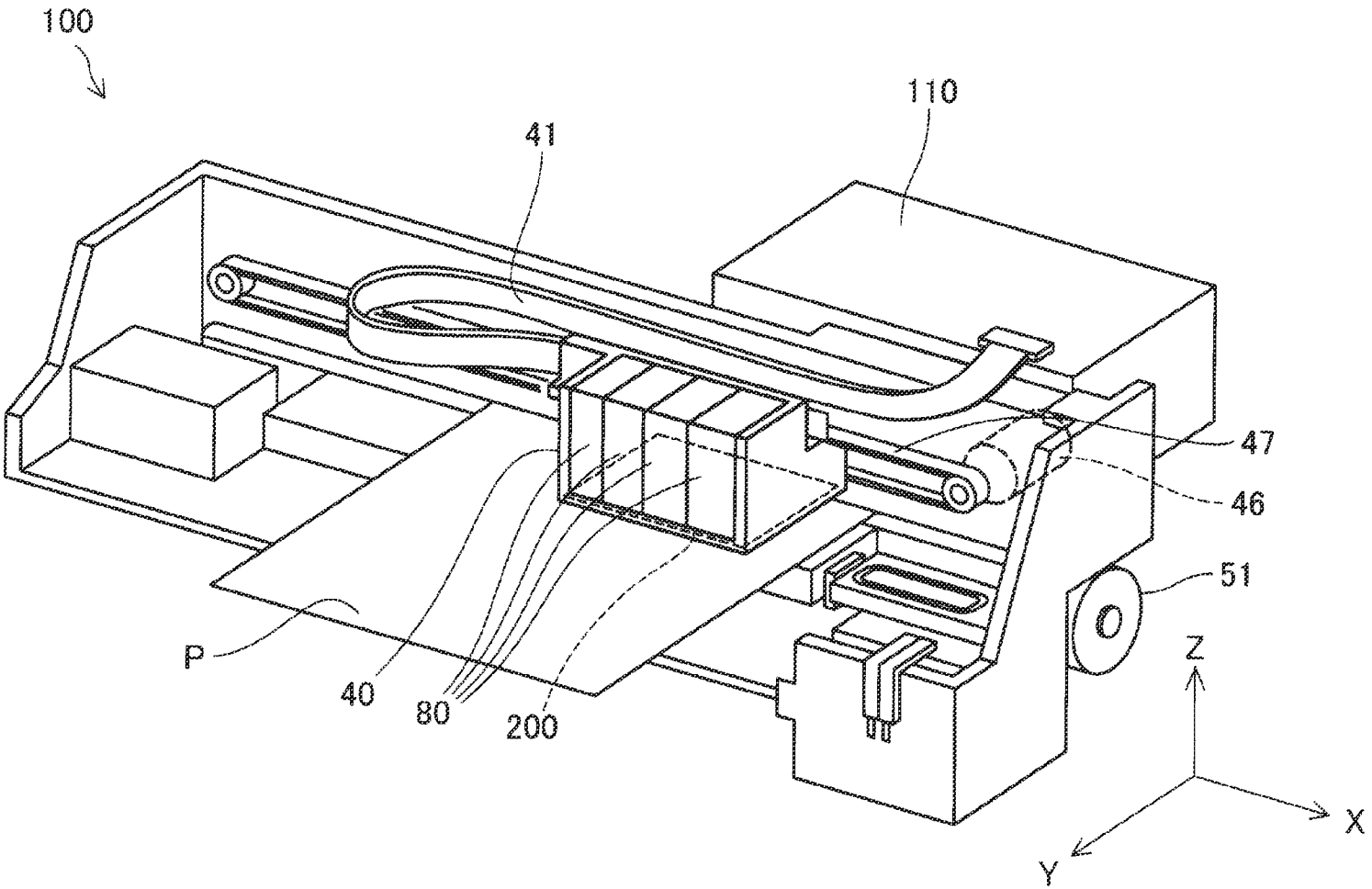
FIG. 1 illustrates a schematic structure of a liquid discharge apparatus that includes a liquid discharge head according to a first embodiment.

FIG. 1 illustrates a schematic structure of a liquid discharge apparatus 100 that includes a liquid discharge head 200 according to a first embodiment. In FIG. 1, respective arrows represent X, Y, and Z directions that are orthogonal to each other. The X direction, the Y direction, and the Z direction respectively denote directions of the X-axis, the Y-axis, and the Z-axis, which are three spatial axes orthogonal to each other, and each have two opposing directions along the X-axis, the Y-axis, and the Z-axis, respectively. More specifically, positive directions along the X-axis, the Y-axis, and the Z-axis correspond to a positive X direction, a positive Y direction, and a positive Z direction, respectively, and negative directions along the X-axis, the Y-axis, and the Z-axis correspond to a negative X direction, a negative Y direction, and a negative Z direction, respectively. A plane in the X direction and the Y direction may be referred to as an XY plane, a plane in the X direction and the Z direction may be referred to as an XZ plane, and a plane in the Y direction and the Z direction may be referred to as a YZ plane. In FIG. 1, the X-axis and the Y-axis are axes along a horizontal plane, and the Z-axis is an axis along a vertical line. In this embodiment, accordingly, the negative Z direction denotes the direction of gravity. In other drawings, the arrows in the X direction, the Y direction, and the Z direction are illustrated as appropriate. The X, Y, and Z directions in FIG. 1 and the X, Y, and Z directions in other drawings represent the same respective directions. Here, "orthogonal" includes a range of 90°±10°.

The liquid discharge apparatus 100 according to the embodiment is an ink jet printer that discharges an ink as a liquid to print an image on a print medium P. The liquid discharge apparatus 100 prints an image on a print medium P by ejecting an ink onto the print medium P, such as paper, in accordance with print data, which represents on/off dot-forming operations to be performed on the print medium P, to form dots at different locations on the print medium P. The print medium P may be paper or any material that can retain liquid, such as plastic, film, fabric, cloth, leather, metal, glass, wood, or ceramics. The liquid to be used in the liquid discharge apparatus 100 may be ink or any liquid, such as various coloring materials, electrode materials, bioorganic or inorganic samples, lubricating oil, resin liquid, or etching liquid.

The liquid discharge apparatus 100 includes the liquid discharge head 200, a carriage 40, a drive motor 46 for driving the carriage 40, a transport motor 51 for transporting a print medium P, an ink cartridge 80, and a controller 110.

The controller 110 is a computer that includes one or more processors, a main storage unit, and an input/output interface for exchanging signals with an external device. The controller 110 controls individual mechanisms in the liquid discharge apparatus 100 in accordance with print data to discharge an ink from the liquid discharge head 200 onto a print medium P to print images on the print medium P. The controller 110, accordingly, controls the liquid discharge operations of the liquid discharge head 200.

The ink cartridge 80 stores an ink, which is a liquid to be supplied to the liquid discharge head 200. In this embodiment, four ink cartridges 80 can be detachably attached to the carriage 40. Each of the four ink cartridges 80 stores, as a liquid, a different color ink. The ink cartridges 80 may be, for example, attached to a main body of the liquid discharge apparatus 100 without being attached to the carriage 40. In another embodiment, the mechanism for storing ink may be, for example, an ink tank or a pouch-shaped ink pack made of a flexible film, and the types of ink storing mechanism, the number of ink storing mechanisms, the types of ink to be stored, and the number of inks to be stored are not limited to particular types or particular numbers.

The liquid discharge head 200 according to the embodiment is held by the carriage 40 and reciprocates together with the carriage 40 in a main scanning direction in response to the driving force transmitted from the drive motor 46 via a drive belt 47 to the carriage 40. The liquid discharge head 200, while reciprocating in the main scanning direction, discharges the inks supplied from the ink cartridges 80 in a form of droplets onto a print medium P, which is transported by the transport motor 51 and a roller (not illustrated) in a sub-scanning direction that intersects the main scanning direction. The main scanning direction according to the embodiment is a direction in the X direction whereas the sub-scanning direction is a direction in the Y direction and is orthogonal to the main scanning direction. It should be noted that in another embodiment, the main scanning direction and the sub-scanning direction are not limited to being orthogonal to each other. The liquid discharge head 200 is electrically coupled to the controller 110 via a flexible cable 41. The liquid discharge head 200 will be described in detail below. It should be noted that the liquid discharge apparatus 100 may include two or more liquid discharge heads 200.

Figure 2:
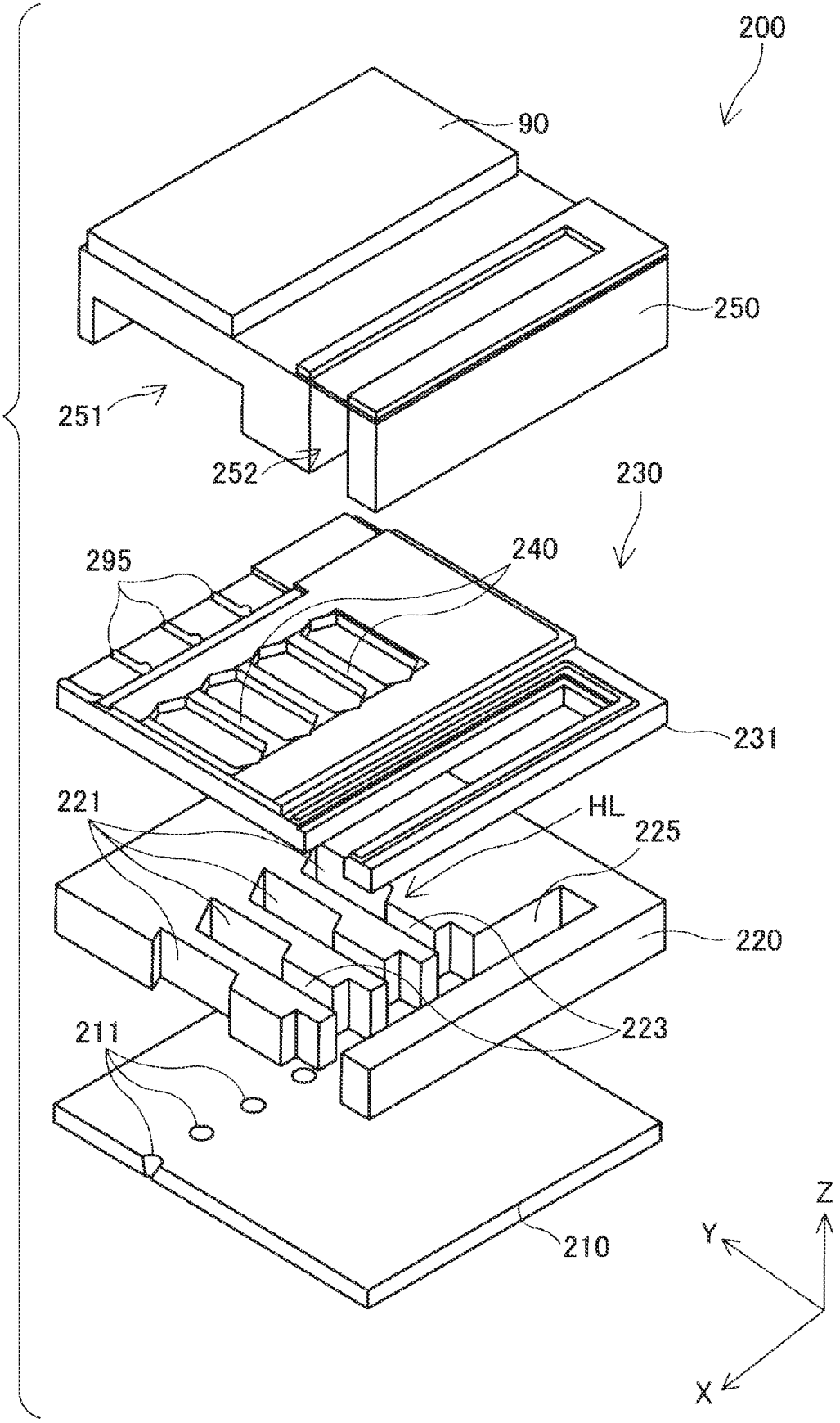
FIG. 2 is an exploded perspective view of a structure of the liquid discharge head according to the embodiment.

FIG. 2 is an exploded perspective view of a structure of the liquid discharge head 200 according to the embodiment. The liquid discharge head 200 according to the embodiment includes a nozzle plate 210, a pressure chamber plate 220, a piezoelectric section 230, and a sealing section 250, which are stacked in the Z direction. A drive circuit 90 is disposed on a surface of the sealing section 250 on the positive side of the Z-axis.

The nozzle plate 210 according to the embodiment is a thin plate-shaped member and is disposed along the XY plane. The nozzle plate 210 has multiple nozzles 211 aligned in the X-axis direction. The liquid discharge head 200 ejects liquid from the nozzles 211. The nozzle plate 210 according to the embodiment is made of stainless steel (SUS). The nozzle plate 210 is not limited to stainless steel, and the nozzle plate 210 may consist of a plate of various metals, such as a nickel (Ni) alloy, resins, such as a polyimide or a dry film resist, or inorganic materials, such as, a single crystal plate of silicon (Si), or glass ceramics. In another embodiment, two or more lines of the nozzles 211 may be formed in the nozzle plate 210.

The pressure chamber plate 220 is a plate-shaped member that defines pressure chambers 221. The pressure chamber plate 220 is joined to a surface of the nozzle plate 210 on the positive side of the Z-axis, for example, with an adhesive, a heat welding film, or the like. The pressure chamber plate 220 has a hole HL that extends through the pressure chamber plate 220 in the Z direction to define the pressure chambers 221, ink supply channels 223, and a communication portion 225. It should be noted that, for example, a vibrating plate 231 may be stacked on the pressure chamber plate 220, and a part of or all of the hole HL may then be formed. The pressure chamber plate 220 according to the embodiment is made of a single crystal plate of silicon (Si). In another embodiment, the pressure chamber plate 220 may be, for example, a plate of other materials composed mainly of silicon (Si), ceramic materials, or glass materials.

The pressure chambers 221 according to the embodiment are aligned in the X direction. The pressure chambers 221 that are defined by the pressure chamber plate 220 that is stacked on the nozzle plate 210 communicate with the corresponding nozzles 211. Each of the pressure chambers 221 is substantially a parallelogram elongated in the Y direction when viewed in the Z direction.

The communication portion 225 is a space common to the pressure chambers 221. The communication portion 225 communicates with each of the pressure chambers 221 through the ink supply channels 223. The ink supply channel 223 is narrower than the pressure chamber 221 and functions as flow channel resistance to the ink supplied from the communication portion 225 to the pressure chamber 221.

The piezoelectric section 230 includes the vibrating plate 231 and the piezoelectric elements 240 stacked on the pressure chamber plate 220. The piezoelectric section 230 can change the volume of the pressure chambers 221 by deforming the piezoelectric elements 240 to vibrate the vibrating plate 231 disposed between the piezoelectric elements 240 and the pressure chamber plate 220. The piezoelectric section 230 may be referred to as an actuator. The piezoelectric section 230 and the piezoelectric elements 240 will be described in detail below.

The sealing section 250 is joined to the piezoelectric section 230 with an adhesive. The sealing section 250 includes a piezoelectric element accommodating section 251 that accommodates the piezoelectric elements 240 and a manifold section 252 that communicates with the communication portion 225 of the pressure chamber plate 220. The sealing section 250 according to the embodiment is made of a single crystal plate of silicon. The sealing section 250 may be made of other materials such as ceramic materials or glass materials. In such a case, the sealing section 250 may be made of a material with a coefficient of thermal expansion substantially the same as that of the pressure chamber plate 220.

The drive circuit 90 supplies the piezoelectric elements 240 with drive signals for driving the piezoelectric elements 240. The drive circuit 90 may be, for example, a circuit board or a semiconductor integrated circuit (IC). The drive circuit 90 is electrically coupled to the piezoelectric elements 240 via lead electrodes 295 and electrical wiring (not illustrated). The drive circuit 90 is electrically coupled to the controller 110 via electrical wiring (not illustrated).

Figure 3:
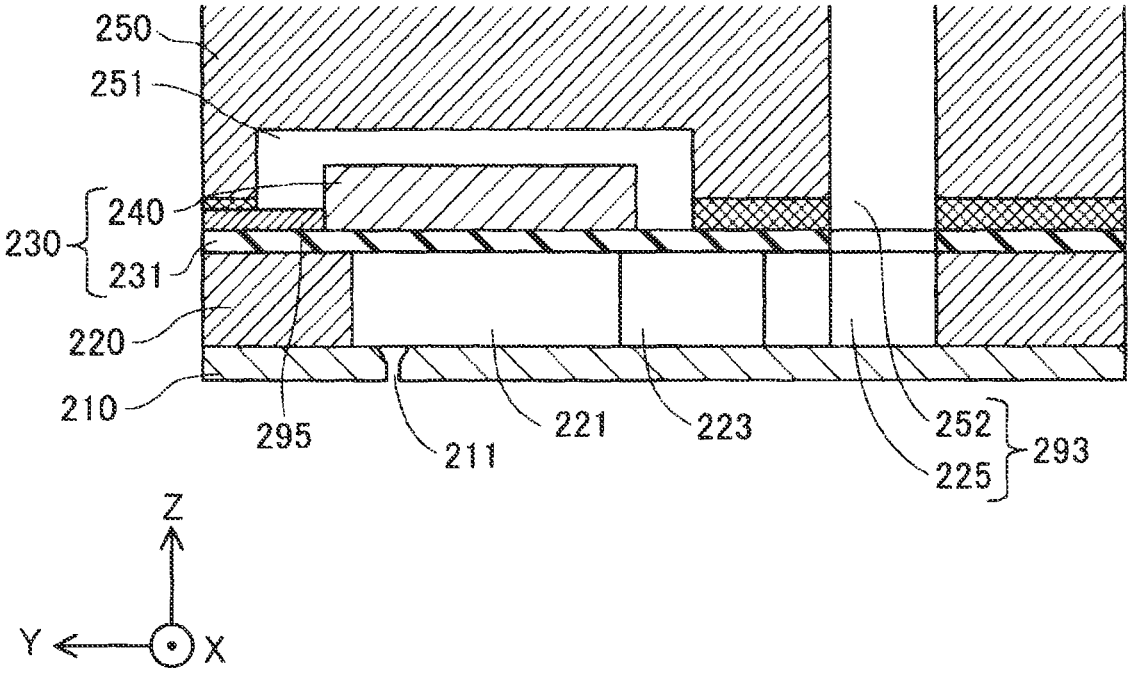
FIG. 3 is a schematic cross-sectional view illustrating main components of the liquid discharge head taken along the YZ plane.

FIG. 3 is a schematic cross-sectional view illustrating main components of the liquid discharge head 200 taken along the YZ plane. As illustrated in FIG. 3, in the structure in which the above-described components are stacked, the manifold section 252 and the communication portion 225 communicate with each other and a manifold 293 functions as a common liquid chamber for the pressure chambers 221. The nozzle 211, the pressure chamber 221, the ink supply channel 223, and the manifold 293 communicate with each other to form an ink flow channel. In the liquid discharge head 200, the volume of the pressure chambers 221 is changed by the piezoelectric section 230 to discharge the liquid, which is supplied to the pressure chambers 221 through the flow channels, from the nozzles 211. The manifold 293 may be referred to as a common liquid chamber or a reservoir.

Figure 4:
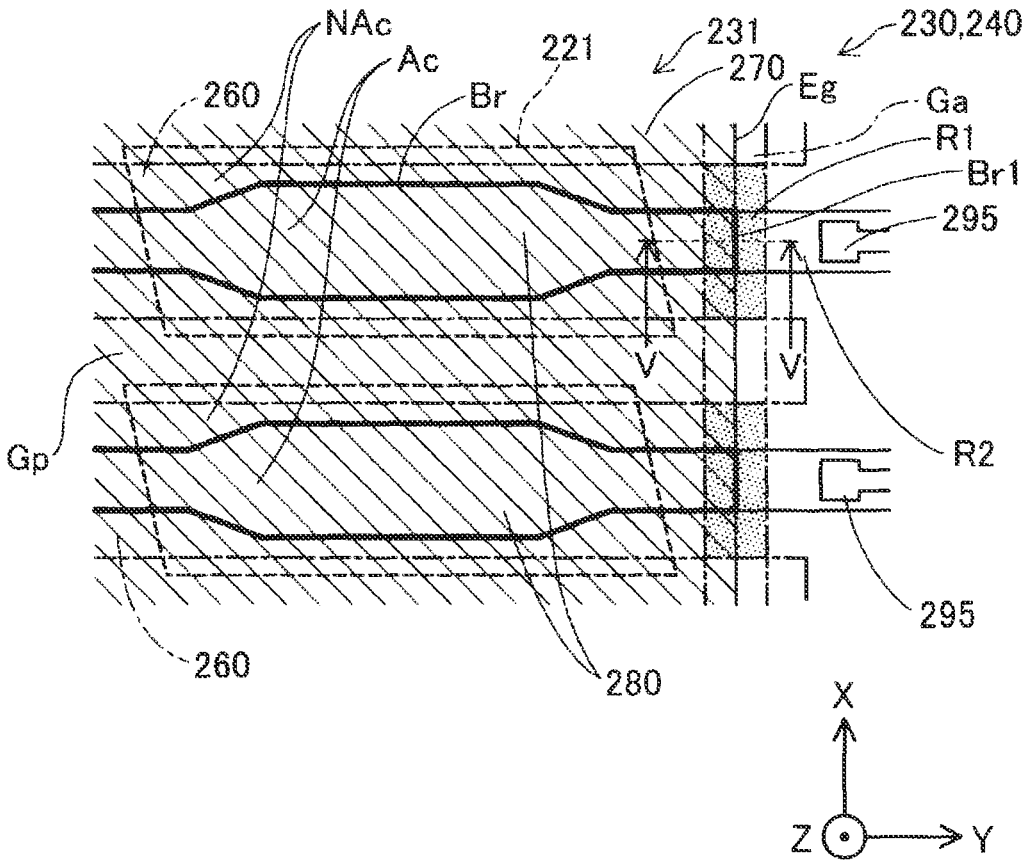
FIG. 4 illustrates a schematic structure of a piezoelectric section.

FIG. 4 illustrates a schematic structure of the piezoelectric section 230. In FIG. 4, the pressure chambers 221 on the XY plane are indicated by broken lines. FIG. 4 also illustrates components of the piezoelectric elements 240, which will be described below, on the XY plane.

Figure 5:
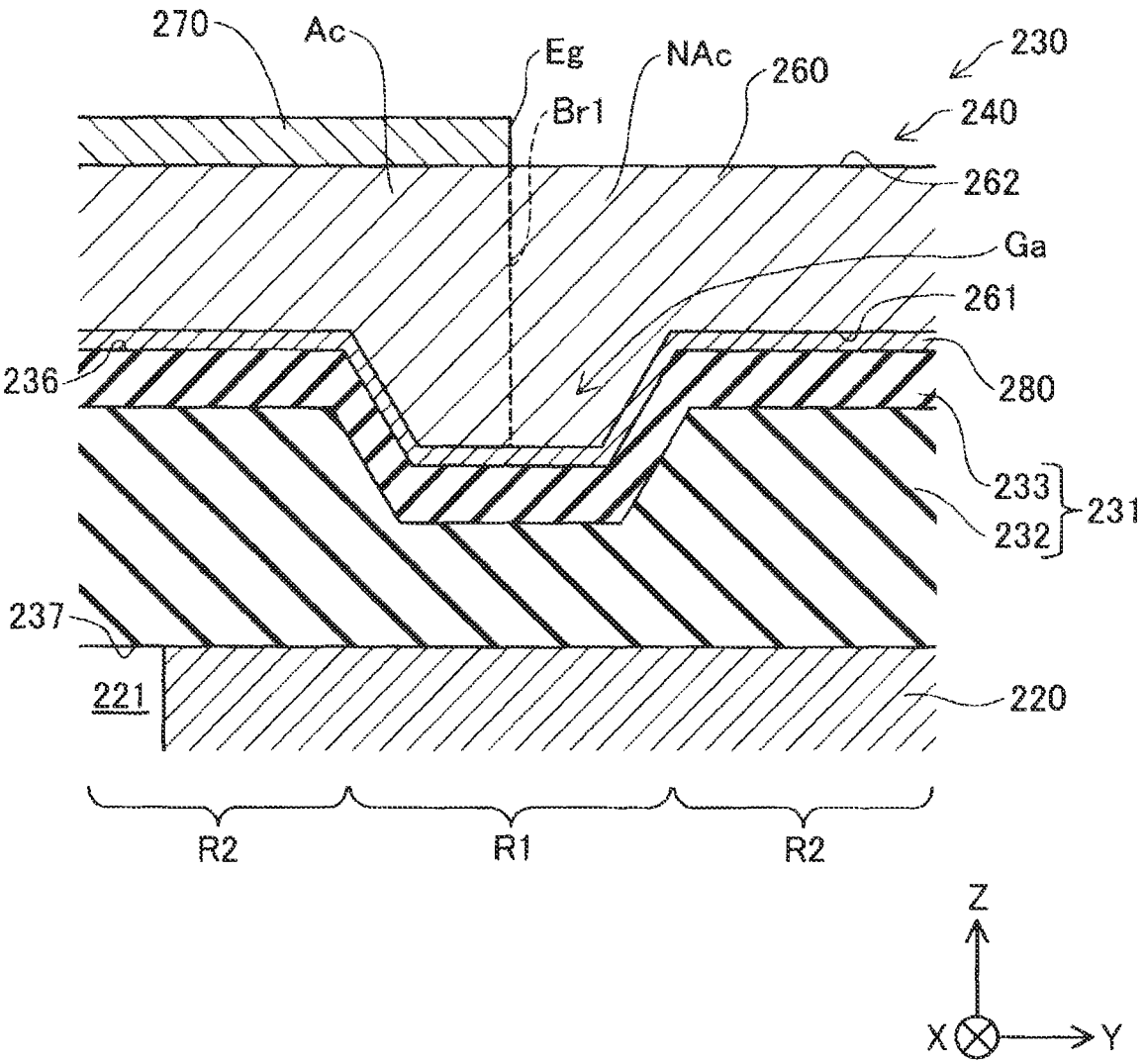
FIG. 5 is a cross-sectional view of the pressure chamber and the piezoelectric section taken along line V-V in FIG. 4.

FIG. 5 is a cross-sectional view of the pressure chamber 221 and the piezoelectric section 230 taken along line V-V in FIG. 4. As described above, the piezoelectric section 230 includes the vibrating plate 231 and the piezoelectric elements 240. The piezoelectric element 240 includes piezoelectric materials 260, a common electrode 270, and individual electrodes 280. The vibrating plate 231, the piezoelectric materials 260, the common electrode 270, and the individual electrodes 280 are stacked in a stacking direction. More specifically, in this embodiment, these components are stacked, in the stacking direction, in the positive Z direction, in the order of the common electrode 270, the piezoelectric materials 260, the individual electrodes 280, and the vibrating plate 231. The stacking direction has two opposing directions along one axis, which are directions along the Z-axis in this embodiment. The positive and negative directions of the stacking direction correspond to the respective positive and negative directions along the Z-axis.

The vibrating plate 231 vibrates in response to the deformation of the piezoelectric elements 240 as described above. More specifically, the piezoelectric materials 260 are electrically activated via the individual electrodes 280 and the common electrode 270, and this causes the vibrating plate 231 to vibrate. As illustrated in FIG. 5, the vibrating plate 231 according to the embodiment includes an elastic layer 232 and an insulating layer 233 that is closer than the elastic layer 232 to the piezoelectric materials 260 in the Z direction. The elastic layer 232 is on the pressure chamber plate 220 and the pressure chambers 221, and the insulating layer 233 is on the elastic layer 232. The elastic layer 232 according to the embodiment is an elastic film made of silicon dioxide, and the insulating layer 233 is an insulating film made of zirconium oxide.

The piezoelectric materials 260 according to the embodiment are made of lead zirconate titanate (PZT). It should be noted that instead of PZT, the piezoelectric materials 260 may be made of any ceramic material that has an ABO3 perovskite structure, such as barium titanate, lead titanate, potassium niobate, lithium niobate, lithium tantalate, sodium tungstate, zinc oxide, barium strontium titanate (BST), strontium bismuth tantalate (SBT), lead metaniobate, lead zinc niobate, or lead scandium niobate. The material of the piezoelectric materials 260 is not limited to the ceramic materials and may be any material that has a piezoelectric effect such as polyvinylidene fluoride or crystal.

The common electrode 270 is a common electrode for the piezoelectric materials 260. The common electrode 270 according to the embodiment is on the piezoelectric materials 260 and may be referred to as an upper electrode. The individual electrodes 280 are electrodes provided for corresponding piezoelectric materials 260. The individual electrodes 280 according to the embodiment are under the piezoelectric materials 260 and may be referred to as lower electrodes. The common electrode 270 and the individual electrodes 280 are made of, for example, a metal such as platinum, iridium, titanium, tungsten, or tantalum, or a conductive metal oxide such as lanthanum nickel oxide (LaNiO3).

As illustrated in FIG. 4, each of the individual electrodes 280 is elongated in the Y direction and extends in the Y direction. The direction in which the individual electrodes 280 extend may be referred to as an extending direction. The extending direction has two opposing directions along one axis, and in this embodiment, the positive and negative directions of the extending direction correspond to the respective positive and negative directions of the Y-axis. The individual electrodes 280 are arranged in an arrangement direction that is orthogonal to the Y direction, which is the extending direction. The arrangement direction has two opposing directions along one axis, which in this embodiment are the directions along the X-axis. The positive and negative directions of the arrangement direction correspond to the respective positive and negative directions of the X-axis.

In FIG. 4, the edges of the piezoelectric materials 260 in the piezoelectric element 240 in the XY plane are indicated by alternating long and short dashed lines. As illustrated in FIG. 4, each of the piezoelectric materials 260 corresponds to the individual electrode 280 and extends in the Y direction, which is the extending direction. The piezoelectric materials 260 are arranged in the X direction, which is an arrangement direction, to correspond to the individual electrodes 280. The piezoelectric materials 260 are arranged with gaps Gp therebetween when viewed in the Z direction.

In FIG. 4, the portion in the piezoelectric element 240 where the common electrode 270 is disposed in the XY plane is hatched by lines sloping downward to the right. FIG. 4 and FIG. 5 illustrate an end portion Eg that is an edge of the common electrode 270 in the Y direction. As illustrated in FIG. 4 and FIG. 5, the common electrode 270 extends over the area on the negative side of the Y-axis with respect to the end portion Eg and is not provided in an area on the positive side of the Y-axis with respect to the end portion Eg.

FIG. 4 and FIG. 5 illustrate active portions Ac and non-active portions NAc. In FIG. 4, a border Br between an active portion Ac and a non-active portion NAc in the XY plane is indicated by a heavy line. The active portion Ac is a portion in the piezoelectric material 260 sandwiched between the common electrode 270 and the individual electrode 280 in the Z direction. The non-active portion NAc is a portion in the piezoelectric material 260 not sandwiched between the common electrode 270 and the individual electrodes 280 in the Z direction. That is, in the piezoelectric material 260, the non-active portion NAc is a portion in the Z direction where neither the common electrode 270 nor the individual electrode 280 is provided, or a portion where only one of the common electrode 270 and the individual electrode 280 is provided.

In the active portion Ac of the piezoelectric material 260, piezoelectric distortion occurs in response to application of a voltage to the piezoelectric material 260 via the common electrode 270 and the individual electrode 280. The piezoelectric element 240 changes the volume of the pressure chamber 221 in response to the displacement caused by the piezoelectric distortion. More specifically, the piezoelectric distortion of the piezoelectric material 260 causes the piezoelectric element 240 to deform the vibrating plate 231 to change the volume of the pressure chamber 221. On the other hand, in the non-active portion NAc of the piezoelectric material 260, in response to application of a voltage to the piezoelectric material 260, no piezoelectric distortion occurs.

FIG. 4 and FIG. 5 illustrate a border Br1 that is a border between an end of the active portion Ac and the non-active portion NAc in the Y direction. In general, like the border Br1, at a border between an end of an active portion Ac and a non-active portion NAc in the extending direction, cracks or the like are likely to be produced due to a difference between the deformation in the active portion Ac and that in the non-active portion NAc. That is, the active portion Ac of the piezoelectric material 260 is elongated in the Y direction, which is the extending direction, and when a voltage is applied to the piezoelectric material 260, the active portion Ac deforms more in the Y direction than in the X direction. On the other hand, in the non-active portion NAc, as described above, when a voltage is applied to the piezoelectric material 260, no piezoelectric distortion occurs. Accordingly, at a border such as the border Br1, cracks or the like are likely to be produced due to stress caused by the difference in deformation between the active portion Ac and the non-active portion NAc.

The piezoelectric material 260 has a first region R1 and a second region R2 when viewed in the Z direction. The first region R1 includes the border Br1 when viewed in the Z direction. In FIG. 4, the first region R1 is hatched in a dot pattern. The second region R2 is a region different from the first region R1. The second region R2 is, accordingly, a region that does not include the border Br1 when viewed in the Z direction. In FIG. 4, the second region R2 is a region that is not hatched in a dot pattern in the portion where the piezoelectric material 260 is provided. As illustrated in FIG. 5, the piezoelectric material 260 in the first region R1 is thicker than the piezoelectric material 260 in the second region R2. In other words, the first region R1 is a region in which the border Br1 is included when viewed in the Z direction and in which the thickness of the piezoelectric material 260 is greater than in the second region R2.

The piezoelectric material 260 that is thicker in the first region R1 than in the second region R2 can more readily distribute a load produced in the first region R1 in the Z direction, which is the thickness direction of the piezoelectric material 260, for example, compared with a piezoelectric material 260 that has the same thickness in the first region R1 and in the second region R2. With this structure, the above-mentioned stress caused by the difference in deformation between the active portion Ac and the non-active portion NAc in the border Br1 can be suppressed. In addition, in the piezoelectric material 260 that is thick in the border Br1, the intensity of an electric field produced in the piezoelectric material 260 in the border Br1 is low, and thus the piezoelectric material 260 is less susceptible to damage even if a high voltage is applied to the piezoelectric material 260. With this structure, for example, the piezoelectric material 260 can be activated by a higher voltage, increasing the amount of liquid discharged from the liquid discharge head 200.

It should be noted that if a piezoelectric material 260 has the same thickness in the first region R1 and in the second region R2, for example, due to an increase in the thickness in both the first region R1 and second region R2, the stress caused by the difference in deformation between the active portion Ac and the non-active portion NAc in the border Br1 can be reduced compared with a piezoelectric material 260 that is thin in both the first region R1 and in the second region R2. In such a case, however, also in the second region R2 where cracks or the like are less likely to be produced compared with the first region R1, the increased thickness of the piezoelectric material 260 decreases the electric field intensity, causing the piezoelectric material 260 to produce less deformation. As a result, the liquid discharge capability of the liquid discharge head 200 may be decreased. In this embodiment, however, as described above, the thickness in the first region R1 is greater than the thickness in the second region R2, for example, to enable the piezoelectric material 260 to be thick in the first region R1 while being thin in the second region R2. With this structure, while the decrease in the liquid discharge capability can be reduced, the stress caused by the difference in deformation between the active portion Ac and the non-active portion NAc in the border Br1 can be suppressed.

The range of the first region R1 is defined by the range of a portion in the piezoelectric material 260 that has a different thickness. In this embodiment, the first region R1 in the X direction has the same width as the piezoelectric material 260 in the X direction. With this structure, the first region R1 is not adjacent to another region in the X direction and has no border with another region in the X direction, thus increasing the durability of the piezoelectric material 260 in the X direction. In addition, the first region R1 in the Y direction has the same width as a groove Ga in the Y direction, which is formed in the vibrating plate 231 and will be described below.

As illustrated in FIG. 4 and FIG. 5, the vibrating plate 231 according to the embodiment has a single groove Ga that extends in the X direction across the piezoelectric materials 260. In this embodiment, the piezoelectric material 260 in a region of the groove Ga is thicker than the piezoelectric material 260 in a region without the groove Ga. That is, the region of the piezoelectric material 260 that corresponds to the groove Ga corresponds to the first region R1, and the region that does not correspond to the groove Ga corresponds to the second region R2. The portion of the vibrating plate 231 where the groove Ga is provided is thinner than the portion of the vibrating plate 231 where no groove Ga is provided. Accordingly, the vibrating plate 231 in the portion that corresponds to the first region R1 is thinner than the vibrating plate 231 in the portion that corresponds to the second region R2.

The groove Ga according to the embodiment is formed by forming a groove in a portion of an upper surface of the elastic layer 232 in the vibrating plate 231. With this structure, as illustrated in FIG. 5, the elastic layer 232 in a region that corresponds to the first region R1 is thinner than the elastic layer 232 in a region that corresponds to the second region R2. The insulating layer 233 in a region that corresponds to the first region R1 has the same thickness as the insulating layer 233 in a region that corresponds to the second region R2. It should be noted that the thicknesses may be a thickness that is not exactly the same, and the insulating layer 233 in the region that corresponds to the second region R2 may have a thickness within a range of ±10% of the thickness of the insulating layer 233 in the region that corresponds to the first region R1. In general, the elastic layer 232 is thicker than the insulating layer 233, and in the elastic layer 232, the thickness in the first region R1 differs from the thickness in the second region R2 to enable the vibrating plate 231 to have a greater difference in the thickness in the first region R1 and in the second region R2.

As illustrated in FIG. 5, the piezoelectric material 260 has a first end surface 261 and a second end surface 262. The first end surface 261 is an end surface of the piezoelectric material 260 on the vibrating plate 231 side in the Z direction, and in this embodiment, the first end surface 261 is a lower surface of the piezoelectric material 260. The second end surface 262 is an end surface of the piezoelectric material 260 that is opposite to the first end surface 261 in the Z direction, and in this embodiment, the second end surface 262 is an upper surface of the piezoelectric material 260. In this embodiment, the second end surface 262 in the first region R1 is in the same position as the second end surface 262 in the second region R2 in the Z direction. It should be noted that the position of the second end surface 262 in the first region R1 and the position of the second end surface 262 in the second region R2 are not limited to being the same, and the second end surface 262 in the first region R1 in the Z direction may be in substantially the same position as the second end surface 262 in the second region R2 in the Z direction.

As illustrated in FIG. 5, the vibrating plate 231 includes a third end surface 236 and a fourth end surface 237. The third end surface 236 is an end surface of the vibrating plate 231 on the piezoelectric material 260 side in the Z direction, and in this embodiment, the third end surface 236 is an upper surface of the vibrating plate 231. The fourth end surface 237 is an end surface of the vibrating plate 231 that is opposite to the third end surface 236 in the Z direction, and in this embodiment, the fourth end surface 237 is a lower surface of the vibrating plate 231. That is, the insulating layer 233 of the vibrating plate 231 has the third end surface 236, and the elastic layer 232 has the fourth end surface 237. In this embodiment, the fourth end surface 237 in a region that corresponds to the first region R1 is in the same position as the fourth end surface 237 in a region that corresponds to the second region R2 in the Z direction. In this embodiment, accordingly, in the region that corresponds to the first region R1 and in the region that corresponds to the second region R2, the vibrating plate 231 has different thicknesses and the piezoelectric material 260 has different thicknesses, but the total thicknesses of the vibrating plate 231, the individual electrode 280, and the piezoelectric material 260 are the same. In another embodiment, in the region that corresponds to the first region R1 and in the region that corresponds to the second region R2, the total thicknesses of the vibrating plate 231, the individual electrode 280, and the piezoelectric material 260 are not limited to being the same.

The piezoelectric section 230 according to the embodiment may be made, for example, by etching with photoresist masking. Here, an example method of manufacturing the piezoelectric section 230 will be described. First, the elastic layer 232 of the vibrating plate 231 is formed on the pressure chamber plate 220 by thermal oxidation, chemical-vapor deposition (CVD), or the like. Then, a notch for forming the groove Ga is formed by patterning on the formed elastic layer 232, and the insulating layer 233 is formed on the elastic layer 232 by CVD or the like. As described above, in this embodiment, a single groove Ga is formed on the vibrating plate 231, and thus the groove Ga can be formed readily compared with forming a plurality of grooves. Then, on the insulating layer 233, the individual electrodes 280 as the lower electrodes are patterned, for example, by sputtering with a target material such as platinum, and etching. Furthermore, precursors of the piezoelectric materials 260 prepared by a sol-gel method are coated on the insulating layer 233 of the vibrating plate 231 and the individual electrodes 280 by a spin-coating method or the like, and the piezoelectric materials 260 are formed by firing or the like. In this embodiment, since the groove Ga has been formed on the vibrating plate 231, using such a solution process, the portions of the piezoelectric materials 260 that correspond to the groove Ga can be readily thickened, enabling the piezoelectric materials 260 in the first region R1 to be thicker than in the second region R2. Then, on the piezoelectric materials 260, the common electrode 270 as the upper electrode is patterned, for example, by sputtering with a target material such as platinum, and etching. It should be noted that in each of the above-described processes, for example, the surface of each component may be smoothed or the thickness may be adjusted by etching or the like as appropriate.

In the liquid discharge head 200 according to the first embodiment, the piezoelectric material 260 in the first region R1 is thicker than the piezoelectric material 260 in the second region R2. With this structure, the load produced in the first region R1 is more likely to be distributed in the Z direction, which is the thickness direction of the piezoelectric material 260. This structure reduces the stress caused by the difference in deformation between the active portion Ac and the non-active portion NAc in the border Br1, suppressing crack formation, or the like in the border Br1.

In addition, in this embodiment, the vibrating plate 231 in the portion that corresponds to the first region R1 is thinner than the vibrating plate 231 in the portion that corresponds to the second region R2. In this structure, for example, by forming the piezoelectric material 260 to have different thicknesses to correspond to the difference in thickness of the vibrating plate 231 in the portion that corresponds to the first region R1 and in the portion that corresponds to the second region R2, the thickness of the piezoelectric material 260 in the first region R1 can be readily thickened compared with the thickness of the piezoelectric material 260 in the second region R2.

In addition, in this embodiment, the elastic layer 232 in the region that corresponds to the first region R1 is thinner than the elastic layer 232 in the region that corresponds to the second region R2. With this structure, by adjusting the thickness of the elastic layer 232, the vibrating plate 231 in the portion that corresponds to the first region R1 can be thicker than the vibrating plate 231 in the portion that corresponds to the second region R2.

In addition, in this embodiment, the insulating layer 233 in the region that corresponds to the first region R1 has the same thickness as the insulating layer 233 in the region that corresponds to the second region R2. With this structure, without changing the thickness of the insulating layer 233 in the first region R1 and the second region R2, the vibrating plate 231 in the portion that corresponds to the first region R1 can be thicker than the vibrating plate 231 in the portion that corresponds to the second region R2.

In addition, in this embodiment, the second end surface 262 of the piezoelectric material 260 in the first region R1 is in the same position as the second end surface 262 in the second region R2 in the stacking direction. With this structure, the second end surface 262 of the piezoelectric material 260 can be smooth.

In addition, in this embodiment, the fourth end surface 237 of the vibrating plate 231 in the region that corresponds to the first region R1 is in the same position as the fourth end surface 237 in the region that corresponds to the second region R2 in the stacking direction. With this structure, the fourth end surface 237 of the vibrating plate 231 can be smooth.

In addition, in this embodiment, in the stacking direction, the common electrode 270, the piezoelectric materials 260, the individual electrodes 280, and the vibrating plate 231 are stacked in this order. This structure reduces the stress caused by the difference in deformation between the active portion Ac and the non-active portion NAc in the border Br1, suppressing crack formation or the like in the border Br1 in the structure in which the common electrode 270 is provided as the upper electrode and the individual electrodes 280 are provided as the lower electrodes. Consequently, the degree of freedom of the structure of the piezoelectric element 240 can be increased.

In this embodiment, the first region R1 in the arrangement direction has the same width as the piezoelectric material 260 in the arrangement direction. With this structure, the first region R1 is not adjacent to another region in the arranging direction, thus the durability of the piezoelectric material 260 in the arrangement direction can be increased.

B. Second Embodiment

Figure 6:
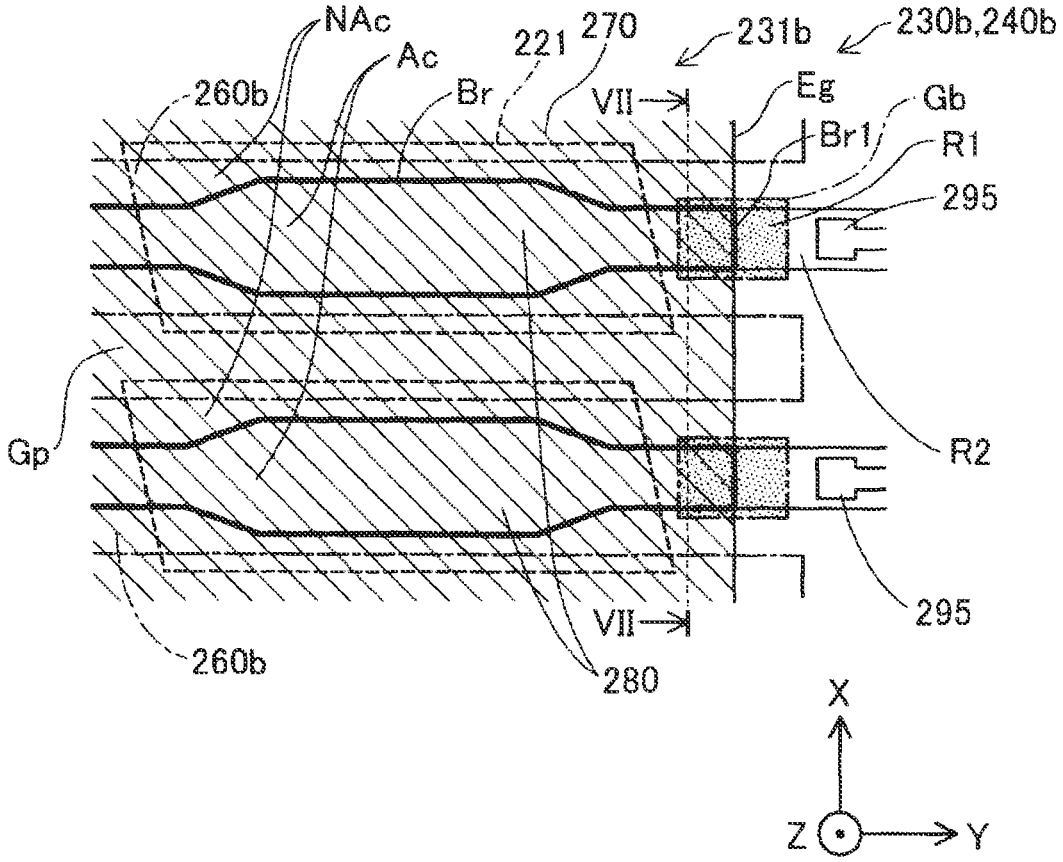
FIG. 6 illustrates a schematic structure of a piezoelectric section according to a second embodiment.

FIG. 6 illustrates a schematic structure of a piezoelectric section 230*b* according to a second embodiment. FIG. 6 also illustrates, in the XY plane, the pressure chambers 221 and components of piezoelectric elements 240*b*, which will be described below, similarly to those in the first embodiment illustrated in FIG. 4. The first region R1 according to the embodiment differs from that in the first embodiment in that the first region R1 in the X direction has a narrower width than the piezoelectric material 260*b* in the X direction. It should be noted that components that are not particularly mentioned in the liquid discharge apparatus 100 and the liquid discharge head 200 according to the second embodiment are similar to those in the first embodiment.

Figure 7:
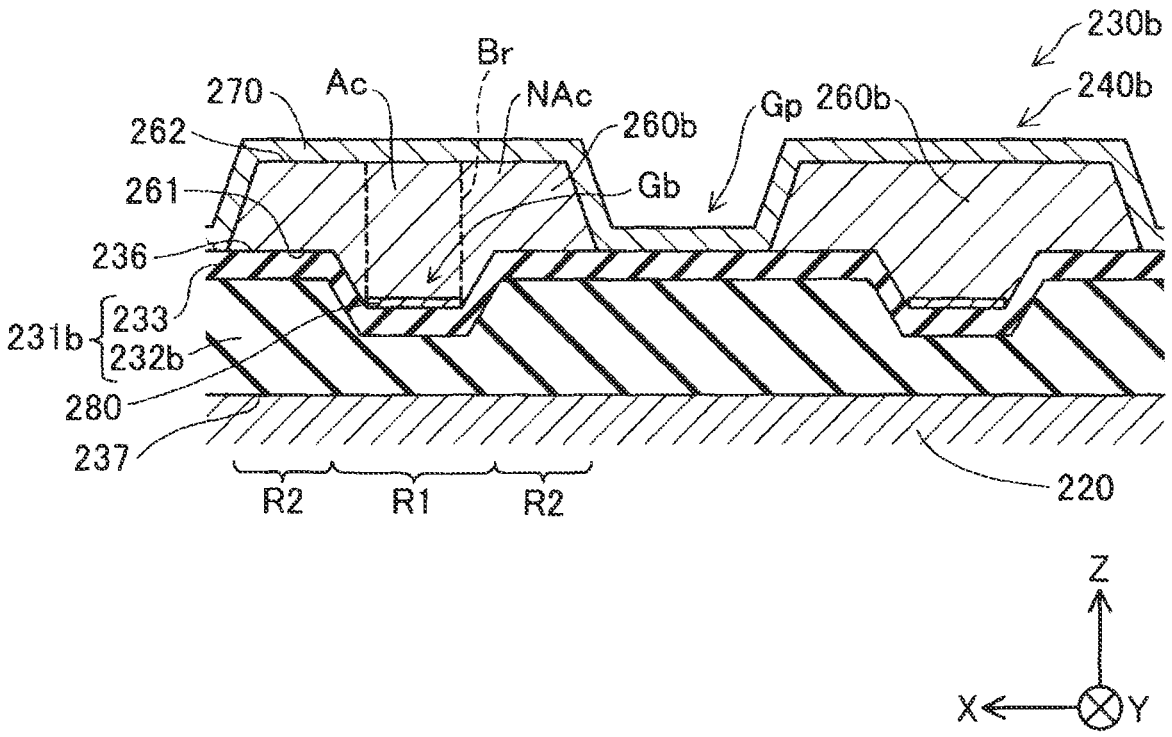
FIG. 7 is a cross-sectional view of the piezoelectric section taken along line VII-VII in FIG. 6.

FIG. 7 is a cross-sectional view of the piezoelectric section 230*b* taken along line VII-VII in FIG. 6. As described above, in this embodiment, since the first region R1 in the X direction has a narrower width than the piezoelectric material 260*b* in the X direction, a region different from the first region R1 exists in the positive X direction and the negative X direction of the first region R1. More specifically, in this embodiment, the second region R2 exists in the positive X direction and the negative X direction of the first region R1. In this embodiment, the load produced in the first region R1 is more likely to be distributed in the Z direction, which is the thickness direction of the piezoelectric material 260*b*, suppressing the stress caused by the difference in deformation between the active portion Ac and the non-active portion NAc in the border Br1. In addition, since the width of the first region R1 in the X direction is narrower than the width of the piezoelectric material 260*b* in the X direction, the dimension in the X direction of a border between the first region R1 and the other region in the Y direction is narrower than the width of the piezoelectric material 260*b* in the X direction. With this structure, crack formation or the like in the border in the Y direction between the first region R1 and the other region can be suppressed. Accordingly, the durability of the piezoelectric material 260*b* in the Y direction can be increased.

A vibrating plate 231*b* according to the embodiment differs from that of the first embodiment in that a plurality of grooves Gb are formed to correspond to the respective plurality of piezoelectric materials 260*b*. The dimension of the groove Gb according to the embodiment in the X direction is less than the dimension of the piezoelectric material 260*b* in the X direction. In this embodiment, similarly to in the first embodiment, the piezoelectric material 260*b* in a region that corresponds to the groove Gb is thicker than the piezoelectric material 260*b* in a region that does not correspond to the groove Gb. That is, the region of the piezoelectric material 260*b* that corresponds to the groove Gb corresponds to the first region R1, and the region that does not correspond to the groove Gb corresponds to the second region R2. In this embodiment, the first region R1 in the X direction and the Y direction has the same dimensions as the groove Gb in the X direction and the Y direction. The grooves Gb according to the embodiment are formed by forming grooves in portions of an upper surface of an elastic layer 232*b* similarly to in the first embodiment.

The grooves Gb that are provided for the respective piezoelectric materials 260*b* increase the durability of the vibrating plate 231*b* compared with a structure in which a single groove is provided across the piezoelectric materials 260*b*. In addition, in patterning the individual electrodes 280 as the lower electrodes by etching, the grooves Gb that have been formed in the respective piezoelectric materials 260*b* facilitate the patterning of the individual electrodes 280 that correspond to the piezoelectric materials 260*b*. Accordingly, the efficiency of the formation of the individual electrodes 280 can be increased.

The liquid discharge head 200 according to the second embodiment can reduce the stress caused by the difference in deformation between the active portion Ac and the non-active portion NAc in the border Br1, suppressing crack formation, or the like in the border Br1. In particular, in this embodiment, the first region R1 in the arrangement direction is narrower than the piezoelectric material 260*b* in the arrangement direction. With this structure, the dimension in the arrangement direction of the border between the first region R1 and the other region in the extending direction is narrower than the width of the piezoelectric material 260*b* in the arrangement direction, increasing the durability of the piezoelectric material 260*b* in the extending direction.

C. Third Embodiment

Figure 8:
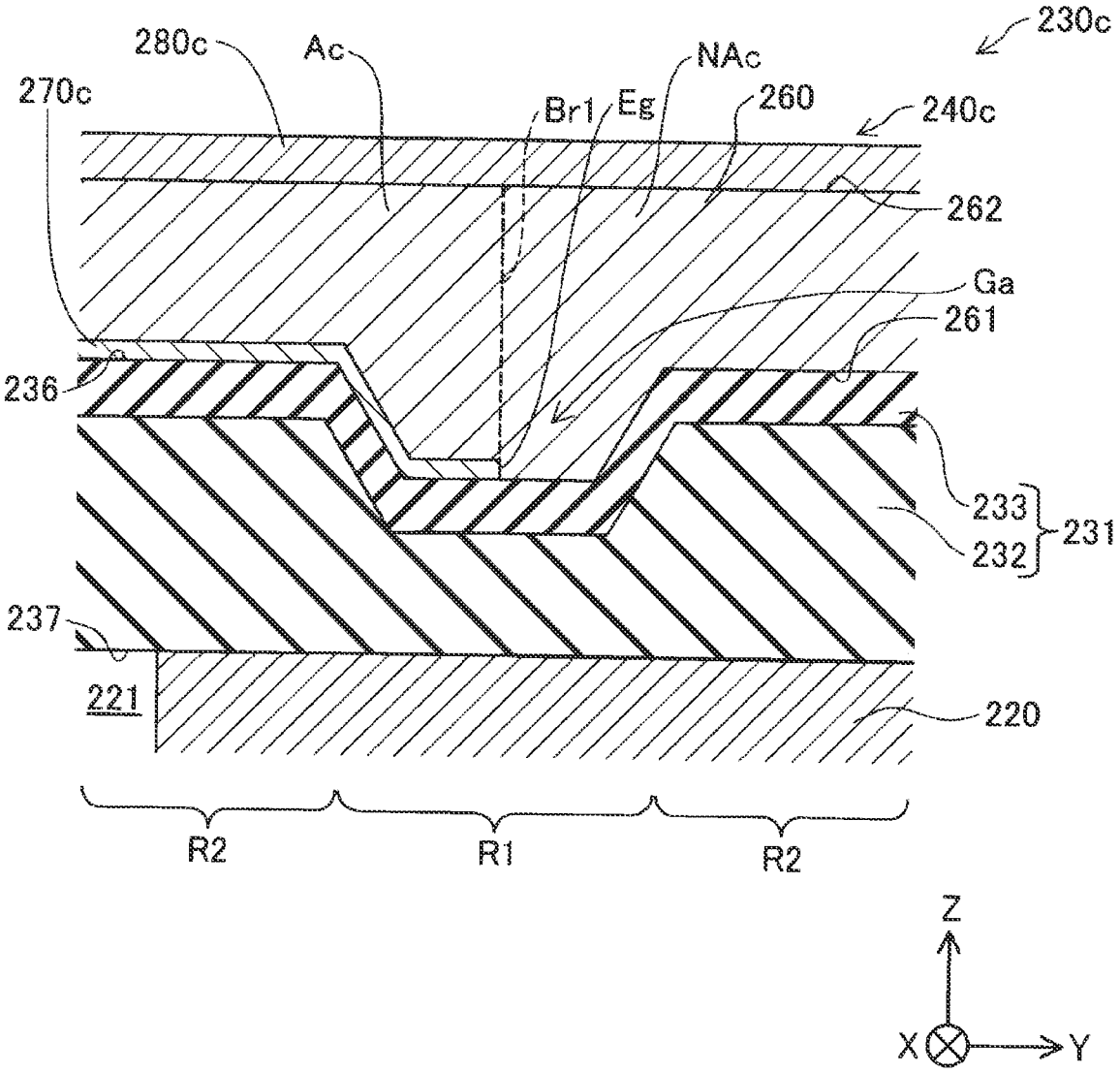
FIG. 8 is a cross-sectional view of a pressure chamber and a piezoelectric section according to a third embodiment taken along the XZ plane.

FIG. 8 is a cross-sectional view of the pressure chamber 221 and a piezoelectric section 230*c* according to a third embodiment taken along the XZ plane. FIG. 8 illustrates the vibrating plate 231 and the piezoelectric element 240*c* similarly to in the first embodiment illustrated in FIG. 5. This embodiment differs from the first embodiment in that, in the Z direction, which is the stacking direction, individual electrodes 280*c*, the piezoelectric materials 260, a common electrode 270*c*, and the vibrating plate 231 are stacked in this order in the positive Z direction. More specifically, the common electrode 270*c* is a lower electrode that is below the piezoelectric materials 260, and the individual electrodes 280*c* are upper electrodes that are above the piezoelectric materials 260. It should be noted that components that are not particularly mentioned in the liquid discharge apparatus 100 and the liquid discharge head 200 according to the third embodiment are similar to those in the first embodiment.

The liquid discharge head 200 according to the third embodiment can also reduce the stress caused by the difference in deformation between the active portion Ac and the non-active portion NAc in the border Br1, suppressing crack formation or the like in the border Br1. In particular, in this embodiment, in the Z direction, the individual electrodes 280*c*, the piezoelectric materials 260, the common electrode 270*c*, and the vibrating plate 231 are stacked in this order. This structure reduces the stress caused by the difference in deformation between the active portion Ac and the non-active portion NAc in the border Br1, suppressing crack formation or the like in the border Br1 in the structure in which the common electrode 270*c* is provided as the lower electrode and the individual electrodes 280*c* are provided as the upper electrodes. Consequently, the degree of freedom of the structure of the piezoelectric element 240*c* can be increased.

D. Other Embodiments

D-1 In the above-described embodiments, the vibrating plate 231 in the portion that corresponds to the first region R1 is thinner than the vibrating plate 231 in the portion that corresponds to the second region R2. However, the vibrating plate 231 in the portion that corresponds to the first region R1 may have the same thickness as the vibrating plate 231 in the portion that corresponds to the second region R2, or may have a thickness greater than the thickness of the vibrating plate 231 in the portion that corresponds to the second region R2. For example, in the first region R1 and the second region R2, the vibrating plate 231 may have the same thickness and the piezoelectric material 260 may have different thicknesses. Accordingly, when the thickness of the piezoelectric material 260 in the first region R1 is greater than the thickness of the piezoelectric material 260 in the second region R2, the regions of the vibrating plate 231 that have different thicknesses are not limited to correspond to the regions of the piezoelectric material 260 that have different thicknesses. For example, as in the first embodiment to the third embodiment, when the vibrating plate 231 has one or more grooves, the range of the first region R1 may be narrower than the region that corresponds to the groove in the piezoelectric material 260.

D-2 In the above-described embodiments, the elastic layer 232 in the portion that corresponds to the first region R1 is thinner than the elastic layer 232 in the portion that corresponds to the second region R2. However, the elastic layer 232 in the portion that corresponds to the first region R1 may have the same thickness as the elastic layer 232 in the portion that corresponds to the second region R2 or may be thicker than the thickness in the portion that corresponds to the second region R2.

D-3 In the above-described embodiments, the insulating layer 233 in the region that corresponds to the first region R1 has the same thickness as the insulating layer 233 in the region that corresponds to the second region R2. On the other hand, the insulating layer 233 in the region that corresponds to the first region R1 may be thicker or thinner than the insulating layer 233 in the region that corresponds to the second region R2.

D-4 In the above-described embodiments, the second end surface 262 of the piezoelectric material 260 in the first region R1 is in the same position as the second end surface 262 in the second region R2 in the stacking direction. However, the second end surface 262 in the first region R1 is not limited to being in the same position as the second end surface 262 in the second region R2 in the stacking direction.

D-5 In the above-described embodiments, the fourth end surface 237 of the vibrating plate 231 in the region that corresponds to the first region R1 is in the same position as the fourth end surface 237 in the region that corresponds to the second region R2 in the stacking direction. However, the fourth end surface 237 in the region that corresponds to the first region R1 is not limited to being in the same position as the fourth end surface 237 in the region that corresponds to the second region R2 in the stacking direction.

E. Other Embodiments

The present disclosure is not limited to the above-described embodiments, and various modifications may be made without departing from the scope of the present disclosure. For example, the present disclosure may be implemented according to the following embodiments. The technical features in the above-described embodiments corresponding to the following embodiments may be replaced or combined as appropriate to solve some or all of the above-described problems or to achieve some or all of the above-described effects. Unless the technical features are described as essential in this specification, the technical features may be omitted as appropriate.

1. According to a first aspect of the present disclosure, there is provided a liquid discharge head that includes piezoelectric materials, individual electrodes each provided to a corresponding one of the piezoelectric materials, a common electrode for the piezoelectric materials, and a vibrating plate configured to vibrate in response to electrical activation of the piezoelectric materials via the individual electrodes and the common electrode. In the liquid discharge head, the piezoelectric materials, the individual electrodes, the common electrode, and the vibrating plate are stacked in a stacking direction, the piezoelectric material has an active portion sandwiched between the individual electrode and the common electrode in the stacking direction, the piezoelectric material has a non-active portion not sandwiched between the individual electrode and the common electrode in the stacking direction, the piezoelectric material has, when viewed in the stacking direction, a first region including a border between an end of the active portion and the non-active portion in an extending direction of the individual electrode, the piezoelectric material has a second region different from the first region, and the piezoelectric material in the first region is thicker than the piezoelectric material in the second region. According to the aspect, the load produced in the first region is more likely to be distributed in the thickness direction of the piezoelectric material. This structure reduces the stress caused by the difference in deformation between the active portion and the non-active portion in the border, suppressing crack formation or the like in the border between the end of the active portion and the non-active portion in the extending direction.

2. In the liquid discharge head according to the aspect, the vibrating plate in a region corresponding to the first region may be thinner than the vibrating plate in a region corresponding to the second region. According to the aspect, for example, by forming the piezoelectric material to have different thicknesses to correspond to the difference in thickness of the vibrating plate in the portion that corresponds to the first region and in the portion that correspond to the second region, the thickness of the piezoelectric material in the first region can be readily thickened compared with the thickness of the piezoelectric material in the second region.

3. In the liquid discharge head according to the aspect, the vibrating plate may include an elastic layer and an insulating layer that is closer to the piezoelectric materials than the elastic layer is in the stacking direction, and the elastic layer in a region corresponding to the first region may be thinner than the elastic layer in a region corresponding to the second region. According to the aspect, by adjusting the thickness of the elastic layer, the vibrating plate in the portion that corresponds to the first region can be thicker than the vibrating plate in the portion that corresponds to the second region.

4. In the liquid discharge head according to the aspect, the insulating layer in a region corresponding to the first region may have the same thickness as the insulating layer in a region corresponding to the second region. According to the aspect, without changing the thickness of the insulating layer in the first region and the second region, the vibrating plate in the portion that corresponds to the first region can be thicker than the vibrating plate in the portion that corresponds to the second region.

5. In the liquid discharge head according to the aspect, the piezoelectric material may have a first end surface that is on a vibrating plate side in the stacking direction and a second end surface that is opposite to the first end surface, and the second end surface in the first region may be in the same position as the second end surface in the second region in the stacking direction. According to the aspect, the second end surface of the piezoelectric material can be smooth.

6. In the liquid discharge head according to the aspect, the vibrating plate may have a third end surface that is on a piezoelectric material side in the stacking direction and a fourth end surface that is opposite to the third end surface, and the fourth end surface in a region corresponding to the first region may be in the same position as the fourth end surface in a region corresponding to the second region in the stacking direction. According to the aspect, the fourth end surface of the vibrating plate can be smooth.

7. In the liquid discharge head according to the aspect, the common electrode, the piezoelectric materials, the individual electrodes, and the vibrating plate may be stacked in this order in the stacking direction. According to the aspect, in the structure in which the common electrode is provided as the upper electrode and the individual electrodes are provided as the lower electrodes, crack formation or the like can be suppressed.

Consequently, the degree of freedom of the structure of the common electrode and the individual electrodes can be increased.

8. In the liquid discharge head according to the aspect, the individual electrodes, the piezoelectric materials, the common electrode, and the vibrating plate may be stacked in this order in the stacking direction. According to the aspect, in the structure in which the common electrode is provided as the lower electrode and the individual electrodes are provided as the upper electrodes, crack formation or the like can be suppressed.

Consequently, the degree of freedom of the structure of the common electrode and the individual electrodes can be increased.

9. In the liquid discharge head according to the aspect, the piezoelectric materials may be arranged in an arrangement direction that is orthogonal to the extending direction.

10. In the liquid discharge head according to the aspect, the first region in the arrangement direction may have the same width as the piezoelectric material in the arrangement direction. According to the aspect, the first region is not adjacent to another region in the arrangement direction, thus the durability of the piezoelectric material in the arrangement direction can be increased.

11. In the liquid discharge head according to the aspect, the first region in the arrangement direction may be narrower than the piezoelectric material in the arrangement direction. According to the aspect, the dimension in the arrangement direction of the border between the first region and the other region in the extending direction is narrower than the width of the piezoelectric material in the arrangement direction. Consequently, the durability of the piezoelectric material in the extending direction can be increased.

12. According to a second aspect of the present disclosure, a liquid discharge apparatus is provided. The liquid discharge apparatus includes the liquid discharge head according to the first aspect, and a controller configured to control a discharge operation of the liquid discharge head. According to the aspect, the load produced in the first region is more likely to be distributed in the thickness direction of the piezoelectric material. This structure reduces the stress caused by the difference in deformation between the active portion and the non-active portion in the border, suppressing crack formation or the like in the border between the end of the active portion and the non-active portion in the extending direction.

The present disclosure is not limited to the liquid discharge head and the liquid discharge apparatus, but may be implemented in various embodiments such as liquid discharge systems and multifunction peripherals that have the liquid discharge apparatus.

What is claimed is:

1. A liquid discharge head comprising:

a plurality of piezoelectric materials;

individual electrodes each provided to a corresponding one of the piezoelectric materials;

a common electrode for the piezoelectric materials; and a vibrating plate configured to vibrate in response to electrical activation of the piezoelectric materials via the individual electrodes and the common electrode, wherein the piezoelectric materials, the individual electrodes, the common electrode, and the vibrating plate are stacked in a stacking direction, the piezoelectric material has an active portion sandwiched between the individual electrode and the common electrode in the stacking direction, the piezoelectric material has a non-active portion not sandwiched between the individual electrode and the common electrode in the stacking direction, the piezoelectric material has, when viewed in the stacking direction, a first region including a border between an end of the active portion and the non-active portion in an extending direction of the individual electrode, the piezoelectric material has a second region different from the first region, and the piezoelectric material in the first region is thicker than the piezoelectric material in the second region.

2. The liquid discharge head according to claim 1, wherein the vibrating plate in a region corresponding to the first region is thinner than the vibrating plate in a region corresponding to the second region.

3. The liquid discharge head according to claim 2, wherein the vibrating plate includes an elastic layer and an insulating layer that is closer to the piezoelectric materials than the elastic layer is in the stacking direction, and the elastic layer in a region corresponding to the first region is thinner than the elastic layer in a region corresponding to the second region.

4. The liquid discharge head according to claim 3, wherein the insulating layer in a region corresponding to the first region has a thickness identical with a thickness of the insulating layer in a region corresponding to the second region.

5. The liquid discharge head according to claim 1, wherein the piezoelectric material has a first end surface that is on a vibrating plate side in the stacking direction and a second end surface that is opposite to the first end surface, and the second end surface in the first region is in a position identical with a position of the second end surface in the second region in the stacking direction.

6. The liquid discharge head according to claim 1, wherein the vibrating plate has a third end surface that is on a piezoelectric material side in the stacking direction and a fourth end surface that is opposite to the third end surface, and the fourth end surface in a region corresponding to the first region is in a position identical with a position of the fourth end surface in a region corresponding to the second region in the stacking direction.

7. The liquid discharge head according to claim 1, wherein the common electrode, the piezoelectric materials, the individual electrodes, and the vibrating plate are stacked in this order in the stacking direction.

8. The liquid discharge head according to claim 1, wherein the individual electrodes, the piezoelectric materials, the common electrode, and the vibrating plate are stacked in this order in the stacking direction.

9. The liquid discharge head according to claim 1, wherein the piezoelectric materials are arranged in an arrangement direction that is orthogonal to the extending direction.

10. The liquid discharge head according to claim 9, wherein the first region in the arrangement direction has a width identical with a width of the piezoelectric material in the arrangement direction.

11. The liquid discharge head according to claim 9, wherein the first region in the arrangement direction is narrower than the piezoelectric material in the arrangement direction.

12. A liquid discharge apparatus comprising:

the liquid discharge head according to claim 1, and a controller configured to control a discharge operation of the liquid discharge head.

* * * * *